United States Patent [19]

Garcia

[11] 4,011,815

[45] Mar. 15, 1977

[54] SAFE-HANDLING ARMING APPARATUS FOR PERFORATING GUNS

[75] Inventor: Jose B. Garcia, Houston, Tex.

[73] Assignee: Schlumberger Technology Corporation, New York, N.Y.

[22] Filed: Oct. 20, 1975

[21] Appl. No.: 623,693

[52] U.S. Cl. ..... 102/20; 89/1 C; 102/70 R; 166/55.1; 175/4.6

[51] Int. Cl.[2] ..... F42C 15/00

[58] Field of Search ..... 102/20, 70.2 R, 70 R; 89/1 C; 166/55.1; 175/4.6, 4.56, 4.55

[56] References Cited

UNITED STATES PATENTS

| | | | |
|---|---|---|---|
| 2,641,185 | 6/1953 | Lockett | 102/20 |
| 2,655,993 | 10/1953 | Spencer | 89/1 C X |
| 2,883,932 | 4/1959 | Caldwell | 89/1 C X |
| 2,924,173 | 2/1960 | Robertson | 89/1 C X |
| 2,925,775 | 2/1960 | McKee | 175/4.6 X |
| 3,052,784 | 9/1962 | Ousley | 102/70.2 X |
| 3,157,119 | 11/1964 | Porter | 175/4.56 X |
| 3,366,179 | 1/1968 | Kinley et al. | 89/1 C X |
| 3,430,568 | 3/1969 | Amster | 102/82 |

*Primary Examiner*—David H. Brown
*Attorney, Agent, or Firm*—Ernest R. Archambeau, Jr.; William R. Sherman; Stewart F. Moore

[57] ABSTRACT

In the representative embodiments of the safe-handling arming apparatus of the present invention disclosed herein, a spring-biased indicator is cooperatively arranged on an enclosed-carrier perforating gun for visually representing whether an obscured or secluded detonator enclosed within the carrier is either in an ineffectual or "safe" status or is in an effective or "armed" status in readiness for detonating one or more shaped explosive charges in the gun. In one embodiment of the new and improved arming apparatus of the present invention, a unique arrangement is provided for releasably retaining a selectively-movable detonator in either of two predetermined operating locations. In another embodiment of the invention, the detonator is instead fixed and isolated by a selectively-movable barrier whose presence or absence is shown by the indicator.

16 Claims, 8 Drawing Figures

SAFE-HANDLING ARMING APPARATUS FOR PERFORATING GUNS

The perforating guns most commonly used in present-day wireline service operations are typically comprised of an elongated fluid-tight body or so-called "enclosed carrier" which houses one or more shaped explosive charges and the necessary accessories for selectively detonating these charges from the surface. One typical style of such carriers employs an expandable, thin-walled steel tube which has reusable upper and lower heads fluidly sealed in each end of the tubing. Other common types of enclosed carriers have heavy, explosion-resistant walls so that the carrier can be reused. This latter type of carrier is ordinarily provided with a removable head or an access port to accommodate the installation of the shaped charges and their associated detonating components.

Those skilled in the art will recognize, of course, that a typical shaped charge perforating gun ordinarily poses no serious hazard so long as there is either an spatial interruption in the explosive detonating train for the gun or the electrical wiring to the detonating train is suitably disconnected. Thus, the usual practice is to substantially complete the assembly of a given gun but, in some approved manner, leave the gun in a relatively safe or "disarmed" condition until just before it is to be operated. For example, where the detonating train for a perforator includes two or more operatively-associated explosives, arrangements can be made for either selectively positioning or removing one of the explosives such as is disclosed in U.S. Pat. No. 2,925,775. Alternatively, another safe-handling technique is simply to not install the electrically-initiated detonator for a given gun until it is being prepared for immediate operation.

It will be appreciated, however, that neither of these typical safe-handling techniques is entirely satisfactory. For example, where a perforator is disarmed by temporarily removing part of its explosive detonating train, there are still safety and logistics problems involved in handling the removed explosive. Moreover, where last-minute electrical connections or other detailed preparations are required to ready the perforator for firing, these final steps often must be made under severe environmental conditions which can easily contribute to either a malfunction or even an unsafe or improper operation. In any event, no fully satisfactory and relatively foolproof system has been provided heretofore for accurately signifying whether a particular enclosed-carrier perforator is armed or disarmed.

Accordingly, it is an object of the present invention to provide new and improved perforating apparatus that is particularly adapted for safe handling and which includes a relatively-foolproof system for indicating the operating status of the apparatus.

This and other objects of the present invention are attained by cooperatively arranging safe-handling arming apparatus on an enclosed-carrier perforating gun to include indicating means for visually signifying whether a detonator on the gun is in readiness for firing of the shaped charges on the gun.

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

Figure 1:
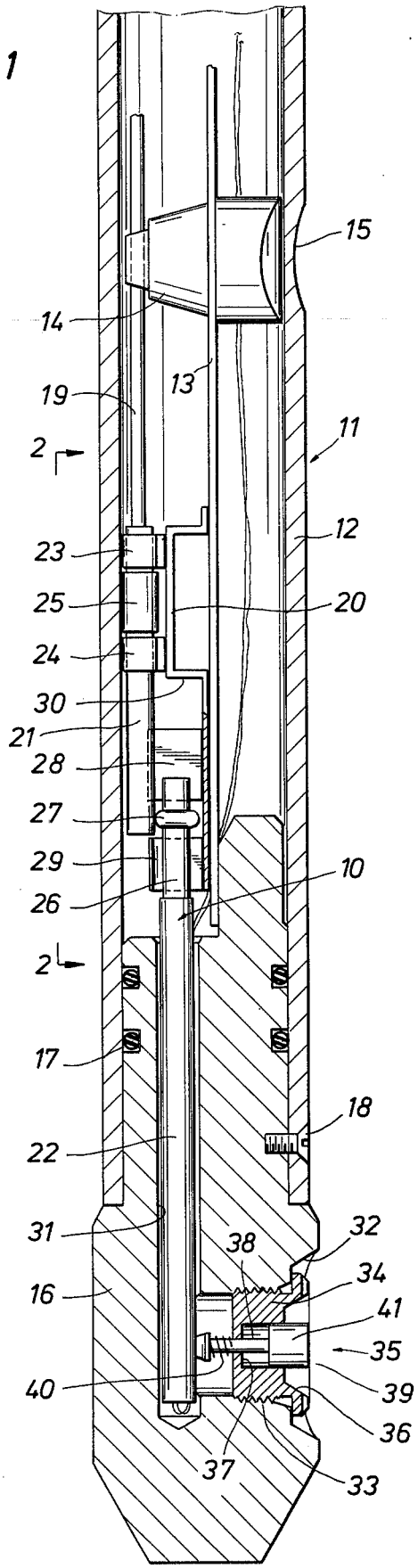
FIGS. 1 and 2 are enlarged cross-sectional views of one preferred embodiment of the present invention in which one element of the detonating means for the perforator is adapted for selective movement into detonating proximity of another element of the detonating means.

Turning now to FIG. 1, an enlarged cross-sectional view is shown of new and improved safe-handling perforator-arming apparatus 10 incorporating the principles of the present invention as this apparatus will typically be arranged on an otherwise-typical expendable-carrier perforator 11 such as fully described in either U.S. Pat. Nos. 3,048,102 or 3,429,384. As illustrated, the perforator 11 includes an expendable tubular housing 12 formed of a length of thin-walled steel tubing and having its upper and fluidly sealed by a reusable head (not shown) suitably arranged to dependently support an elongated metal strip 13 having enlarged openings arranged at spaced intervals therealong for receiving a corresponding number of typical shaped explosive charges as at 14. Each of the shaped charges, as at 14, are mounted on the support strip 13 and preferably faced toward reduced-thickness wall portions, as at 15, of the tubular housing 12 which are respectively shaped in keeping with one or the other of the two last-mentioned patents. The lower end of the carrier housing 12 is closed by a reusable head 16 that is fluidly sealed within the carrier, as by an O-ring 17, and secured by screws 18. To controllably detonate the charges, the perforator 11 has a charge-detonating train which includes a length of detonating cord 19 extending along the strip 13 that is successively positioned in detonating proximity of each shaped charge, as at 14, and operatively coupled to the new and improved arming apparatus 10.

Figure 2:
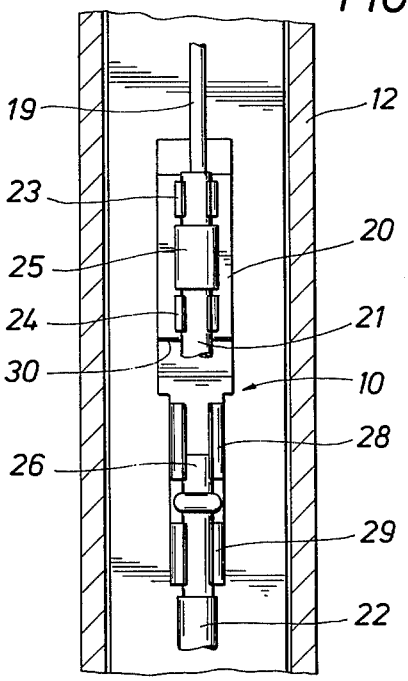

In the preferred embodiment of the new and improved arming apparatus 10 illustrated in FIGS. 1 and 2, a somewhat Z-shaped or stepped bracket 20 is secured to the lower end of the charge-mounting strip 13 and cooperatively arranged for supporting a typical receptor explosive or booster 21 and a donor explosive or electrically-actuated detonator 22 in alternative positions as required either for effectively isolating these two explosive devices or for reliably retaining them in close, detonating proximity of one another to complete the detonating train of the perforator 11. As is customary, the lower end of the detonating cord 19 is securely crimped in a socket in the booster 21. To facilitate the assembly of the perforating gun 11, a pair of U-shaped spring clips 23 and 24 are mounted on the upper leg of the bracket 20 and appropriately placed as required for respectively receiving the upper portion of the booster 21 and the lowermost end portion of the detonating cord 19. An enlarged sealing sleeve or elastomeric grommet 25 is preferably disposed around the junction of the detonating cord 19 and the booster 21 and appropriately sized to closely fit the available space between the spring clips 23 and 24 so that the booster will be fixedly retained in its illustrated position against axial displacement.

The detonator 22 is provided with a position-determining or yieldable detent member such as may be conveniently supplied by an elongated, elastomeric tang 26 arranged on the upper end of the detonator and having an enlarged mid-portion 27 which is adapted to be releasably confined between spaced, upper and lower U-shaped clips 28 and 29 that are mounted on the lower leg of the bracket 20. As depicted, the lower clip is especially sized in relation to the tang 26 and its enlarged shoulder 27 so as to enable the shoulder to be yieldably forced through the lower clip 29 in response to the application of a moderate axial force on the detonator 22. The outer tips of the lower clip 29 are, however, turned inwardly as required for preventing lateral displacement of the detonator through the clip. Similarly, the upper clip 28 is also sized to enable the resilient shoulder 27 to be forced longitudinally through the clip in response to a moderate axial force on the detonator but without allowing either the detent member 26 or the detonator 22 to be moved sidewise between the inwardly-turned tips of the upper clip.

Accordingly, it will be recognized that when the safe-handling perforator-arming apparatus 10 of the present invention is positioned as illustrated in FIG. 1, the detonator 22 is located at a sufficient spacing or safe distance beyond the lower end of the booster 21 that accidental initiation of the detonator will assuredly be ineffectual for detonating the booster charge. For given sizes of the booster 21 and the detonator 22, the spacing between the upper end of the clip 29 and the lower end of the clip 28 will, of course, determine the safe or "disarmed" remote position of the relatively-movable detonator when the perforator 11 is intended to be inoperable. Similarly, it will be understood that with a given booster, as at 21, in its fixed position as determined by the location of the clip 24, the location of the upper end of the clip 28 will establish the lower limit of the other or "armed" position of the detonator 22 when the perforator 11 is intended to be in readiness. As illustrated in FIGS. 1 and 2, it should also be noted that the upper limit of the "armed" position of the detonator 22 will be determined by the engagement of the upper end of the elastomeric tang 26 against the downwardly-facing shoulder 30 defined by the junction of the two legs of the support bracket 20.

As best illustrated in FIG. 1, it will be seen that the lower head 16 is provided with a longitudinally-directed bore or blind passage 31 which is suitably sized and situated for receiving at least the lower portion of the detonator 22. A lateral port 32 affording access to the passage 31 is positioned at a convenient location on the side of the lower head 16 below the lower end of the tubular housing 12 and threaded, as at 33, as required for receiving a suitable closure plug, as at 34, for blocking the entrance of unwanted debris and the like.

Accordingly, the several elements of the new and improved perforator-arming apparatus 10 of the invention are cooperatively arranged so that when the detonator 22 is in its lowermost or "disarmed" position, its lower end will be accessibly disposed in relation to the port 32. Preferably, this is accomplished by simply arranging the axis of the longitudinal passage 31 to intersect with the axis of the lateral port 32 at some convenient location which will assuredly be occupied by the detonator 22 only when it is in its "disarmed" position.

Figure 3:
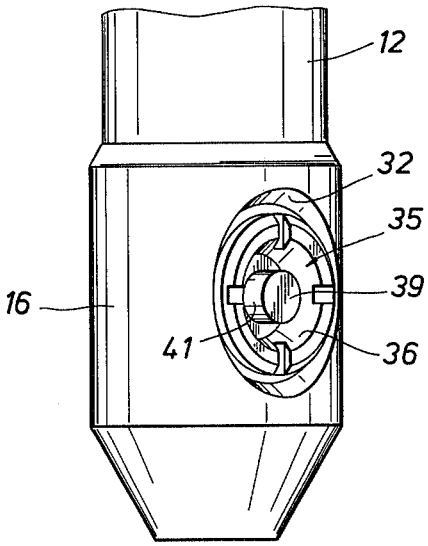
FIG. 3 is an isometric view showing the new and improved indicating means depicted in FIG. 1 visually representing that the perforator is safely disarmed.

It will, therefore, be realized from FIG. 1 that when the detonator 22 is in its depicted "disarmed" position, there is at best only minimal available clearance space interiorly of the closure plug 34. Accordingly, in keeping with the objects of the present invention, the new and improved perforator-arming apparatus 10 further includes indicator means 35 cooperatively arranged for visually signifying whether the detonator 22 is occupying the space in the passage 31 in the immediate proximity of the closure plug 34. In the preferred embodiment of the indicator means 35 as depicted in FIGS. 1 and 3, the closure member 34 is provided with an axial bore which is operatively counterbored to define an enlarged, easily-viewed recess 36 in the outer surface of the closure member and a smaller chamber 37. The indicator means 35 further include a movable member such as a plunger 38 having an enlarged outer head 39 that is slidably fitted in the chamber 37 and an inner portion extended sufficiently beyond the interior face of the closure member 34 to be certain that it will contact a detonator, as at 22, which is then occupying the lower end of the passage 31 when the closure member is threaded into the port 32. A spring, as at 40, is cooperatively arranged for normally biasing the plunger 38 inwardly in relation to the closure member 34.

It will be recognized, therefore, that by suitably proportioning the several elements of the perforator-arming apparatus 10 as illustrated in FIGS. 1 and 3, the enlarged plunger head 39 will be projected outwardly well into the recess 36 in the closure member 34 whenever a detonator, as at 22, is installed in the perforator 11 and is in a "disarmed" or safe position. Thus, to signify this safe condition, it is preferred to make the plunger head 39 distinctive in some manner such as by coloring its cylindrical sides, as at 41, green.

Figure 4:
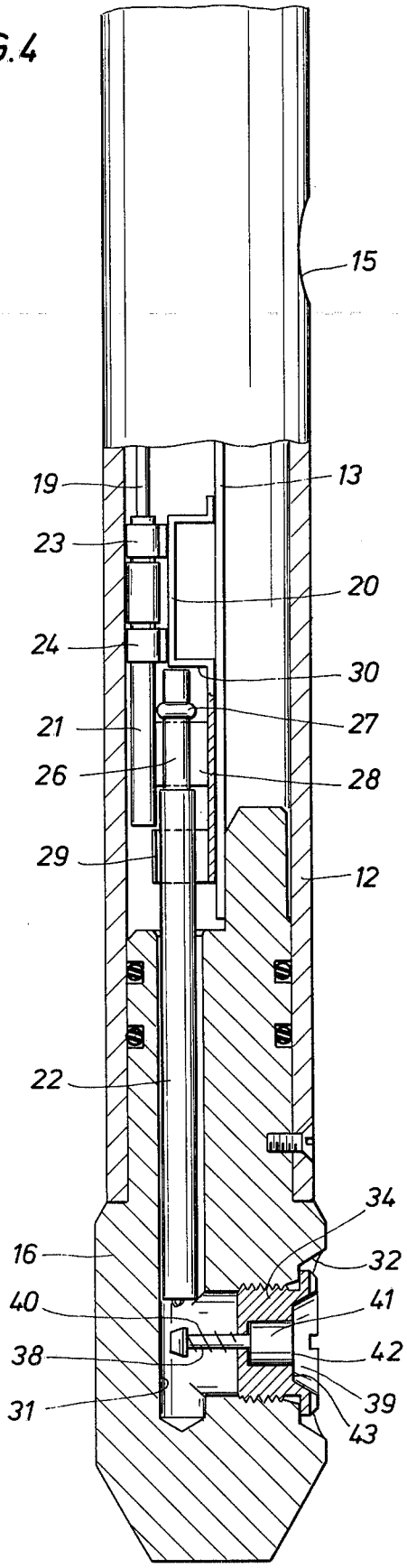
FIGS. 4–6 are views respectively similar to FIGS. 1–3 but showing the positions of the several elements of that embodiment of the perforator-arming apparatus of the present invention when the perforator is armed.
Figure 5:
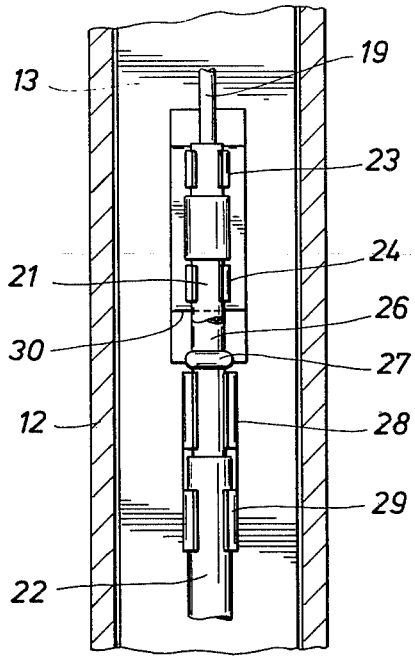
Figure 6:
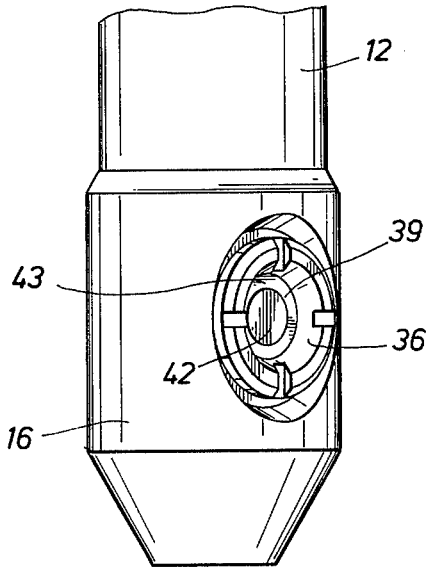

Turning now to FIGS. 4–6, it will be seen that whenever the detonator 22 is moved upwardly to its depicted "armed" position, its lower end will no longer be adjacent to the port 32. This will, of course, allow the spring 40 to bias the plunger 38 inwardly to its fully-retracted position. Accordingly, as best illustrated in FIG. 4 and 6, the outer end 42 of the plunger head 39 is preferably arranged to be substantially flush with the bottom surface 43 of the recess 36 when the plunger 38 is fully retracted. This will correspondingly cause the distinctively-colored sides 41 of the plunger head 39 to be effectively concealed within the small chamber 37 in the closure member 34.

In the depicted embodiment of the present invention, it is preferred, therefore, that the bottom surface 43 of the recess 36 as well as the top surface 42 of the plunger head 39 also be distinctively identified such as by coloring those surfaces red. This will, of course, mean that when the detonator 22 is in detonating proximity of the booster 21, the outward appearance of the indicator means 35 will signify a potentially-dangerous condition as clearly represented by the entire recess 36 being colored wholly red as at 42 and 43 in FIG. 6. It should be noted that it makes no practical difference if there is actually no detonator in the gun 11, the perforator should still be handled as if it is fully armed until the closure member 34 is removed for closer inspection. On the other hand, as shown in FIG. 3, when the plunger head 39 is projected outwardly into the recess 36, the contrasting green color of the sides 41 in relation to the red surfaces 42 and 43 will unequivocably visually indicate that a detonator, as at 22, is then occupying a position in which the perforator 11 is assuredly known to be safely disarmed.

Thus, if a handling procedure is established which calls for all perforators, as at 11, to be completely assembled and all electrical connections to be made at the outset, it can thereafter be reliably assumed that if the indicator means 35 show green the detonator 22 is obviously installed in the gun but that the gun is then unquestionably in a safe or disarmed operating status. This assurance will, of course, allow the perforating gun 11 to be freely handled and with no reason for people working around it to be needlessly concerned about safety. As a psychological factor, it would seem that even uninformed bystanders will also tend to readily understand that the appearance of green on the indicator means 35 signifies that the gun 11 is safe and disarmed. Conversely, if the indicator means 35 instead present a wholly-red appearance, it can always be reliably assumed that the perforator 11 is either in a fully-armed operating status or else there is no detonator installed in the lower head 16. In either case, the perforator 11 must, of course, be treated with complete caution until such time that the true operating status of the gun is reliably ascertained. Hereagain, it will be recognized that the all-red appearance of the closure plug 34 will give a psychological representation of danger.

As far as handling of the new and improved perforator-arming apparatus 10 goes, those skilled in the art will readily appreciate that once it becomes established procedure that all guns, as at 11, are always to be completely assembled and all electrical connections made at the outset, it will then become commonplace to simply rely upon the indicator means 35. So long as the green sides 41 of the plunger head 39 are visible, it can be reliably understood that the perforator 11 is safely disarmed; but if only the red top 42 of the plunger head is visible, the gun is to be considered as being fully armed and in complete readiness for firing.

It will, of course, be recognized that the illustrated closure member 34 is totally unsuited for sealing the port 32 against the entrance of well bore fluids. Thus, although a seal such as an O-ring could readily be arranged around the plunger head 39, it is preferred to simply replace the closure member 34 with a conventional port plug at the time the gun 11 is about to be used. The replacement of the closure member 34 not only eliminates an additional potential source of fluid leakage, but also has the added advantage of leaving the plunger 38 completely free to move without any restraint such as might otherwise be caused by the friction of a seal.

Figure 7:
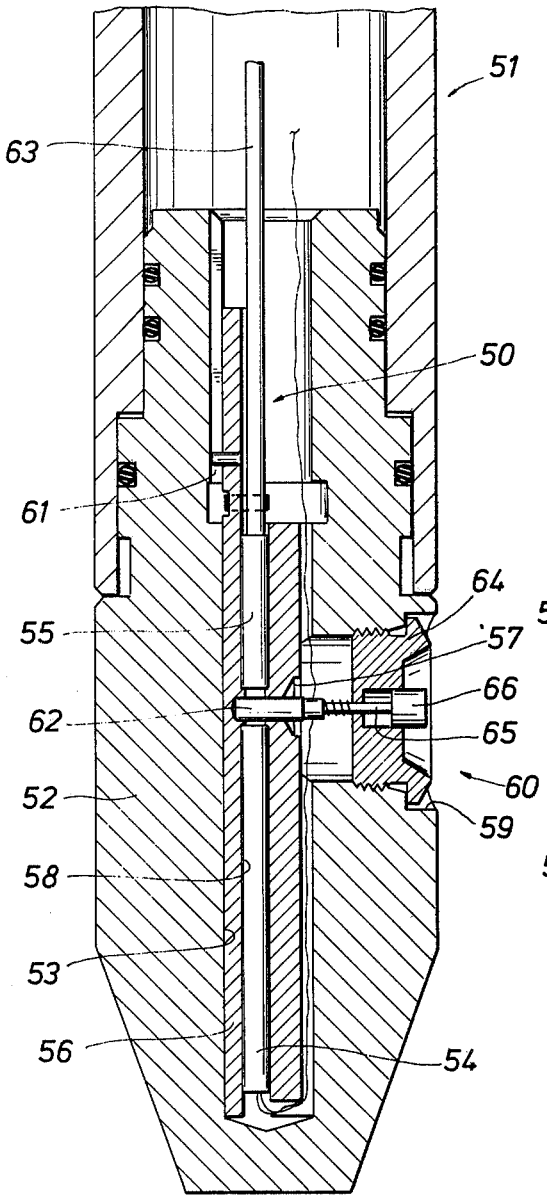
FIGS. 7 and 8 depict an alternative embodiment of perforator-arming apparatus of the present invention.
Figure 8:
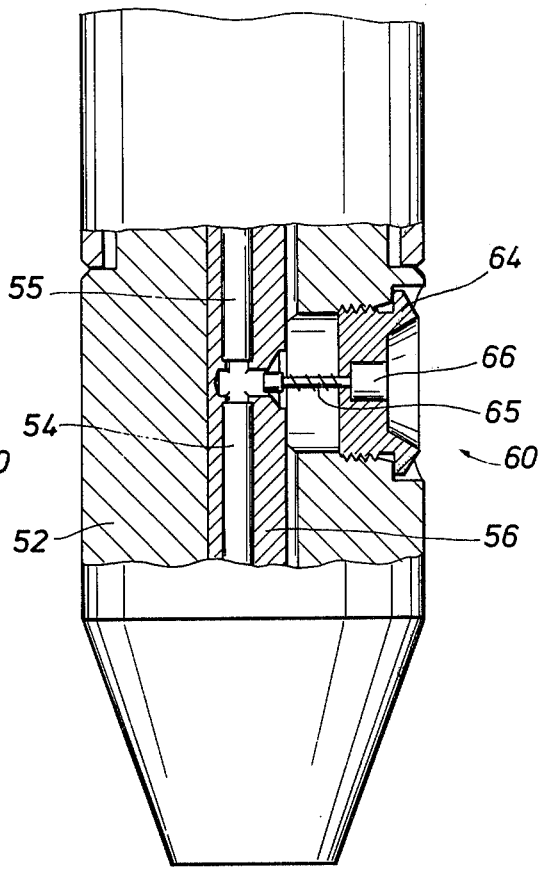

Turning now to FIGS. 7 and 8, an alternative embodiment is shown of new and improved safe-handling perforator-arming apparatus 50 also arranged in accordance with the principles of the present invention. As illustrated, the perforator 51 has a lower head 52 with a chamber or blind passage 53 sized as required for receiving a detonator 54 and at least the lower end of a typical booster 55. To facilitate the assembly of the gun 51, the detonator 54 and the booster 55 are cooperatively mounted together on a common base such as may be conveniently provided by an elongated tube 56 sized as required for holding the two explosive devices within detonating proximity of one another. In the preferred embodiment of the safe-handling apparatus 50, the support tube 56 is provided with a lateral bore 57 that is cooperatively situated to intersect the internal bore 58 of the support tube at a point between the opposed ends of the detonator 54 and the booster 55 when they are mounted in the tube. Access to the lateral bore 57 is gained by means of a threaded port 59 located in the lower head 52 and adapted for carrying indicator means 60 similar or identical to the indicator means 35.

As a matter of convenience, the support tube 56 is arranged with means such as a suitable key and index groove arrangement as shown generally at 61 for angularly orienting the support tube so as to align the lateral bore 57 with the access port 59. In this manner, it will be seen that the access port 59 will always be immediately adjacent to one end of the lateral bore 57 in support tube 56 thereby providing convenient access to the exposed end of a barrier member 62 loosely fitted in the lateral bore. Thus, as will be appreciated by those skilled in the art, by forming the barrier member 62 of a steel rod or of some other material with sufficient thickness to block or effectively prevent the direct transmission of significant detonation forces from the detonator 54 to the booster 55 it can be reasonably assured that so long as the barrier is in place detonation of the detonator will be incapable of setting off the booster. It must, of course, be recognized that the presence of the barrier 62 between the detonator 54 and the booster 55 is effective for causing the receptor explosive to be out of detonating proximity of the donor explosive.

It has been considered best to form the support tube 56 of some non-metallic substance such as wood, plastic or the like so as to attenuate or dampen any substantial shock waves that might otherwise be reflected from the side walls of the passage 53 and set off the booster 55 should the detonator 54 be inadvertently set off. Thus, when the barrier 62 is in position, detonation of the less-sensitive booster 55 is reasonably precluded. Similarly, by virtue of the shock-attenuating material used for the support tube 56, it may be reasonably expected that should a typical booster, as at 55, be desensitized by the unwanted leakage of well bore liquids into the perforator 51, there will be a significant absorption of any reflected shock waves that might otherwise set off the booster if the detonator 54 is fired.

At any rate, if will be recognized from FIG. 7 that once the new and improved safe-handling arming apparatus 50 is in position and is operatively coupled to a detonating cord, as at 63, the presence or absence of the barrier member 62 will determine whether or not the detonating train of the gun 51 is in condition for firing. Accordingly, in keeping with the objects of the present invention, the indicating means 60 are arranged similarly or identically to the indicator 35 previously described with reference to FIGS. 1–6. Thus, with a closure member 64 having a spring-biased indicator plunger 65 that is always in alignment with the lateral bore 57, the position of the plunger head 66 will always provide a visual indication of the presence or absence of the barrier 62. As illustrated in FIGS. 7 and 8, it will, of course, be noted that the plunger 65 is of insufficient length to itself serve as a substitute for the barrier 62.

Thus, it will be known that whenever a safe or "green" visual signal is provided by the indicating means 60, the barrier 62 is in position to reliably disarm the perforator 51. On the other hand, if the indicating means 60 is instead showing a danger or "all red" visual signal, it can be reliably assumed that the perforator 51 is armed and in condition for firing. Hereagain, although the indicator means 60 could instead be cooperatively arranged to prevent leakage around the plunger 65, it is preferred to simply replace it with a conventional closure member or port plug (not shown) whenever the gun 51 is finally being armed for immediate operation. This is, of course, best done at the time the barrier 62 is removed as by a pair of long-nosed pliers (not shown) as the gun 51 is being readied for lowering into a well bore that is to be perforated.

Accordingly, it will be appreciated that the present invention has provided alternative embodiments of new and improved arming apparatus for particular application with oilfield perforating equipment. By arranging a visual indicator on the perforating equipment to visually signify whether or not the perforator can be fired, those working with or around the perforator will be aware of its actual condition so as to act accordingly. Moreover, by virtue of the new and improved arming apparatus disclosed here, a perforator can be fully assembled and left in an inoperable position which is virtually detectable. However, with only a minimum of preparation, the perforator can be readily armed and this armed condition will also be signified by the new and improved apparatus of the present invention.

While only particular embodiments of the present invention have been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. A well bore perforator comprising:

an enclosed carrier having an access port on one side thereof;

a port cover adapted for blocking said access port;

explosive means in said carrier and including at least one shaped explosive charge, a receptor detonating explosive cooperatively arranged and adapted for detonating said shaped explosive charge, and a selectively-intiatible donor detonating explosive adapted for detonating said receptor explosive;

charge-arming means in said carrier operable by way of said access port and cooperatively arranged for selectively supporting said detonating explosive either in a predetermined perforator-arming operating position within relative detonating proximity of one another or in a predetermined perforator-disarming operating position out of relative detonating proximity of one another; and indicating means operable only when said port cover is blocking said access port and including an indicating plunger movably mounted in said port cover and adapted to be uniquely positioned by one of said detonating explosives only when said detonating explosives are in one of their two said operating positions so that the relationship of an exposed portion of said indicating plunger relative to said port cover will visually signify when said detonating explosives are in their said one operating position.

2. The perforating apparatus of claim 1 wherein said exposed portion of said indicating plunger has a distinctive surface which is exposed only when said detonating explosives are in their said one operating position and is obscured only when said detonating explosives are in the other of their said operating positions.

3. A well bore perforator comprising:

an enclosed carrier having an access port on one side thereof;

a port cover adapted for blocking said access port;

explosive means in said carrier and including at least one shaped explosive charge, a receptor detonating explosive cooperatively arranged ad adapted for detonating said shaped explosive charge, and a selectively-initiatible donor detonating explosive adapted for detonating said receptor explosive;

charge-arming means in said carrier cooperatively retaining said detonating explosives in detonating proximity of one another and including a detonation-attenuating barrier cooperatively arranged within reach of said access port either for selective installation between said detonating explosives to prevent detonation of said receptor explosive upon initiation of said donor explosive or for selective removal from therebetween to effect detonation of said receptor explosive upon initiation of said donor explosive; and indicating means operable only when said port cover is blocking said access port and including an indicating plunger movably mounted in said port cover and adapted to be uniquely positioned by said barrier only when it is installed between said detonating explosives so that the relationship of an exposed portion of said indicating plunger relative to said port cover will visually signify whether or not said barrier member is installed.

4. The perforating apparatus of claim 3 wherein said exposed portion of said indicating plunger has a distinctive surface which is exposed only when the barrier is installed between said detonating explosives and is obscured only when said barrier is not installed between said detonating explosives.

5. Apparatus comprising:

a hollow body having an access opening cooperatively arranged therein;

explosive means including a charge-detonating explosive train in said body and having a receptor explosive and a selectively-initiatible donor explosive adapted for detonating said receptor explosive;

explosive-arming means in said body and selectively operable when said access opening is uncovered for alternatively establishing said charge-detonating train either in an armed operating status where initiation of said donor explosive will be effectual for detonating said receptor explosive or in a disarmed operating status where initiation of said donor explosive will be ineffectual for detonating said receptor explosive; and status-indicating means operable when said access opening is covered for providing a visual indication exterior of said body representative of at least one operating status of said charge-detonating explosives.

6. The apparatus of claim 5 wherein said status-indicating means include a movable indicator member cooperatively arranged for alternative displacement between one indicating position characteristically signifying said armed operating status and another indicating position characteristically signifying said disarmed operating status.

7. The apparatus of claim 5 wherein said explosive-arming means include explosive-positioning means situated in said body and manually operable by way of said access opening for selectively locating said charge-detonating explosive in one or the other of two predetermined positions respectively in and out of effectual detonating proximity of one another when said charge-detonating explosives are established in their said armed and disarmed operating states respectively; and said status-indicating means include a movable indicator member cooperable with at least one of said charge-detonating explosives for providing said visual indication at least when said charge-detonating explosives are located in a selected one of their said two predetermined positions.

8. The apparatus of claim 5 wherein said explosive-arming means include explosive-positioning means situated in said body and manually operable by way of said access opening for selectively locating said charge-detonating explosives in one or the other of two predetermined positions respectively in and out of effectual detonating proximity of one another when said charge-detonating explosives are established in their said armed and disarmed operating states respectively; and said status-indicating means include a movable indicator member cooperatively arranged to be engaged with one of said charge-detonating explosives only when said charge-detonating explosives are located in a selected one of their said two predetermined positions for providing a first characteristic visual indication and to be disengaged therefrom only when said charge-detonating explosives are located in the other of their said two predetermined positions for providing a second characteristic visual indication.

9. The apparatus of claim 5 wherein said explosive-arming means include a barrier member manually movable by way of said access opening between a detonation-blocking interposed position between said charge-detonating explosives and a detonation-enabling remote position away from said detonating-blocking position; and said status-indicating means include a movable indicator member cooperable with said barrier member for providing said visual indication at least when said barrier member is in a selected one of its said two positions.

10. The apparatus of claim 5 wherein said explosive-arming means include a barrier member manually movable by way of said access opening between a detonation-blocking interposed position between said charge-detonating explosives and a detonation-enabling remote position away from said charge-detonating explosives; and said status-indicating means include a movable indicator member cooperatively arranged to contact said barrier member only when said barrier member is in its said detonation-blocking position for providing a first characteristic visual indication and to be out of contact therewith only when said barrier member is in its said detonation-enabling position for providing a second characteristic visual indication.

11. The apparatus of claim 5 wherein said explosive means further include a shaped explosive charge operatively associated with said receptor explosive and adapted for detonation only in response to deontation of said receptor explosive.

12. The apparatus of claim 11 wherein said shaped charge is also in said body.

13. Apparatus comprising:

an enclosed shaped charge carrier having an access opening therein;

charge-arming means in said carrier manually operable by way of said access opening and, whenever charge-detonating explosive means are disposed in said carrier, adapted for alternatively situating such charge-detonating explosive means either in an armed operating condition or in a disarmed operating condition;

a closure member adapted for closing said access opening; and indicator means including a member movably mounted on said closure member and operable when said closure member is closing said access opening for movement to one indicating position for providing a visual indication exterior of said carrier uniquely representative of said armed operating condition and for movement to another indicating position for providing a visual indication exterior of said carrier uniquely representative of said disarmed operating condition.

14. The apparatus of claim 13 wherein said movable member has a distinctive portion thereof which is alternatively obscured or exposed as said movable member respectively assumes its two said indicating positions.

15. Apparatus comprising:

an enclosed shaped charge carrier having an access opening therein;

charge-arming means in said carrier including a detonation-attenuating barrier alternatively positionable or removable by way of said access opening and, whenever charge-detonating explosive means are disposed in said carrier, adapted for respectively blocking or enabling the transmission of effectual charge-detonating explosive forces from such charge-detonating explosive means;

a closure member adapted for closing said access opening; and indicator means including a member movably mounted on said closure member and operable when said closure member is closing said access opening for movement to one indicating position for providing a visual indication exterior of said carrier uniquely representative of the effectual positioning of said barrier within said carrier and for movement to another indicating position for providing a visual indication exterior of said carrier uniquely representative of the absence of said barrier from within said carrier.

16. The apparatus of claim 15 wherein said movable member has a distinctively-arranged surface thereof which is alternatively obscured or exposed as said movable member respectively assumes its two said indicating positions.

* * * * *